US007602673B2

(12) United States Patent
Jung et al.

(10) Patent No.: US 7,602,673 B2
(45) Date of Patent: Oct. 13, 2009

(54) SYSTEM FOR CONTROLLING TIMER VIA NETWORK

(75) Inventors: Joon Young Jung, Daejeon (KR); Jeun Woo Lee, Daejeon (KR); Dong Wan Ryoo, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 125 days.

(21) Appl. No.: 11/772,970

(22) Filed: Jul. 3, 2007

(65) Prior Publication Data

US 2008/0123474 A1 May 29, 2008

(30) Foreign Application Priority Data

Jul. 7, 2006 (KR) ..... 10-2006-0064007

(51) Int. Cl.
*G04B 47/00* (2006.01)
*G04C 11/00* (2006.01)
*G08B 1/00* (2006.01)

(52) U.S. Cl. ..... 368/10; 368/46; 340/309.6; 340/309.8

(58) Field of Classification Search ..... 368/46, 368/47, 10, 107, 108; 307/141.4; 340/309.16, 340/309.3, 309.4, 309.6, 309.8, 309.9
See application file for complete search history.

(56) References Cited

U.S. PATENT DOCUMENTS 5,440,559 A * 8/1995 Gaskill ..... 370/314
5,661,700 A * 8/1997 Weppler ..... 368/46
5,848,028 A * 12/1998 Burklin
6,095,031 A * 8/2000 Warne
6,112,127 A * 8/2000 Bennett
6,198,408 B1 * 3/2001 Cohen
6,215,862 B1 * 4/2001 Lopes ..... 379/110.01
6,236,623 B1 * 5/2001 Read et al. ..... 368/46
6,269,055 B1 * 7/2001 Pikula et al. ..... 368/47
6,275,922 B1 * 8/2001 Bertsch ..... 712/36
6,577,231 B2 * 6/2003 Litwin, Jr. et al.
6,587,739 B1 * 7/2003 Abrams et al.
6,658,303 B2 * 12/2003 Hatemata et al. ..... 700/14
6,678,215 B1 * 1/2004 Treyz et al. ..... 368/10
6,690,979 B1 * 2/2004 Smith
6,873,573 B2 * 3/2005 Pikula et al. ..... 368/10
6,882,712 B1 * 4/2005 Iggulden et al.
6,968,471 B2 * 11/2005 Daum (Continued)

FOREIGN PATENT DOCUMENTS

JP 11-259386 9/1999

(Continued)

*Primary Examiner*—Vit W Miska
(74) *Attorney, Agent, or Firm*—Ladas & Parry LLP

(57) ABSTRACT

A timer control device controlling at least one timer-controlled device having a timer built therein via a network, the time control device including: a timer setting unit setting an operating time and an operating method of the timer built in the at least one timer-controlled device; a timer absolute time provider providing a standard time of an area in which the timer control device is located; a control message generator generating a control message by combining the operating time and operating method of the timer of the timer setting unit with the standard time of the timer absolute time provider; and a control message transmitter transmitting the control message generated by the control message generator to the at least one timer-controlled device.

12 Claims, 5 Drawing Sheets

U.S. PATENT DOCUMENTS

| | | | | |
|---|---|---|---|---|
| 6,987,709 | B2 * | 1/2006 | Phillips | 368/46 |
| 7,120,092 | B2 * | 10/2006 | del Prado Pavon et al. | |
| 7,162,517 | B2 * | 1/2007 | Hallenbeck | |
| 7,362,213 | B2 * | 4/2008 | Cohen | 340/309.16 |
| 7,366,959 | B2 * | 4/2008 | Mizumaki | |
| 7,480,210 | B2 * | 1/2009 | Pikula et al. | 368/10 |
| 2002/0018402 | A1 * | 2/2002 | Egle et al. | 368/46 |
| 2005/0174889 | A1 * | 8/2005 | Marcantonio et al. | |
| 2007/0067300 | A1 * | 3/2007 | Ollis et al. | 707/10 |
| 2007/0223445 | A1 * | 9/2007 | Baek | 370/350 |
| 2008/0316870 | A1 * | 12/2008 | Pikula et al. | 368/47 |

FOREIGN PATENT DOCUMENTS

| | | |
|---|---|---|
| JP | 2005-099886 | 4/2005 |
| KR | 1020010094613 | 11/2001 |
| KR | 1020020078728 | 10/2002 |
| KR | 1020030002346 | 1/2003 |
| KR | 1020030059694 | 7/2003 |
| KR | 1020030066549 | 8/2003 |
| KR | 1020040006166 | 1/2004 |
| WO | WO01/48569 | 7/2001 |

* cited by examiner

SYSTEM FOR CONTROLLING TIMER VIA NETWORK

CROSS-REFERENCE TO RELATED APPLICATIONS

This application claims the priority of Korean Patent Application No. 10-2006-0064007 filed on Jul. 7, 2006, in the Korean Intellectual Property Office, the disclosure of which is incorporated herein by reference.

BACKGROUND OF THE INVENTION

1. Field of the Invention

The present invention relates to a system for controlling a timer via a network, the system capable of increasing accuracy and convenience by improving accuracy of time synchronization.

2. Description of the Related Art

Development of electronic technology has embodied automation of plants, offices, and homes. Particularly, as most basic technology of automation, there is a timer function of electronic devices. The timer function of electronic devices allows a corresponding device to operate or to stop operating at a time set by a user, which notably improves functions of general home appliances such as washing machines, electric rice-cookers, electric fans, air-conditioners, and televisions and office automation appliances such as computers.

Korean Patent Application No. 10-2003-0049496 discloses "Engine Control System Using Timer" in which a method of automatically operating an engine to automatically start or to automatically stop at an appointed time set by a user by attaching a system intelligently controlling a vehicular engine start schedule using time sensing by a timer, without a general portable remote controller.

However, though general timer functions are used in various forms in addition to reservation and operation of home appliances, a user has to directly operate each timer one by one to use them.

Also, there are a considerable number of electronic products using a timer. When controlling timers of many products simultaneously, not only it is difficult to accurately operate but also there is required a lot of time since general timers are manually set one by one.

Recently, there is provided a technology of operating a device to be reserved and turned on/off from a long distant place by using a home server connected to a home network to which a plurality of home appliances whose terminal is connected to the network wired or wireless. However, in this case, a time difference or interval between a point in time to request control and a point in time to actually control home appliances may occur due to a transmission delay of the network and it is difficult to control home appliances simultaneously.

Also, since a time difference between areas is not considered, there is a limit on remote control from an area in a different time zone.

SUMMARY OF THE INVENTION

An aspect of the present invention provides a system for controlling a timer via a network, the system capable of more accurately controlling the timer by providing a standard time and a timer operating time of a corresponding area to the timer located in one of a distant area and a local area via the network.

According to an aspect of the present invention, there is provided a timer control device controlling at least one timer-controlled device having a timer built therein via a network, the timer control device including: a timer setting unit setting an operating time and an operating method of the timer built in the at least one timer-controlled device; a timer absolute time provider providing a standard time of an area in which the timer control device is located; a control message generator generating a control message by combining the operating time and operating method of the timer of the timer setting unit with the standard time of the timer absolute time provider; and a control message transmitter transmitting the control message generated by the control message generator to the at least one timer-controlled device.

According to another aspect of the present invention, there is provided a timer-controlled device including: a control message receiver receiving a message via a network; a control message analyzer analyzing the message received by the control message receiver and extracting an operating time and operating method of a timer and a standard time of an area from which the message is transmitted; a controlled timer absolute time provider providing a standard time of an area in which the timer-controlled device is located; a time adjuster comparing the standard time extracted by the control message analyzer with the standard time provided by the controlled timer absolute time provider and adjusting the operating time of the timer, extracted by the control message analyzer by a time difference therebetween; and a controlled timer setting unit operating the timer according to the operating time and operating method of the timer.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
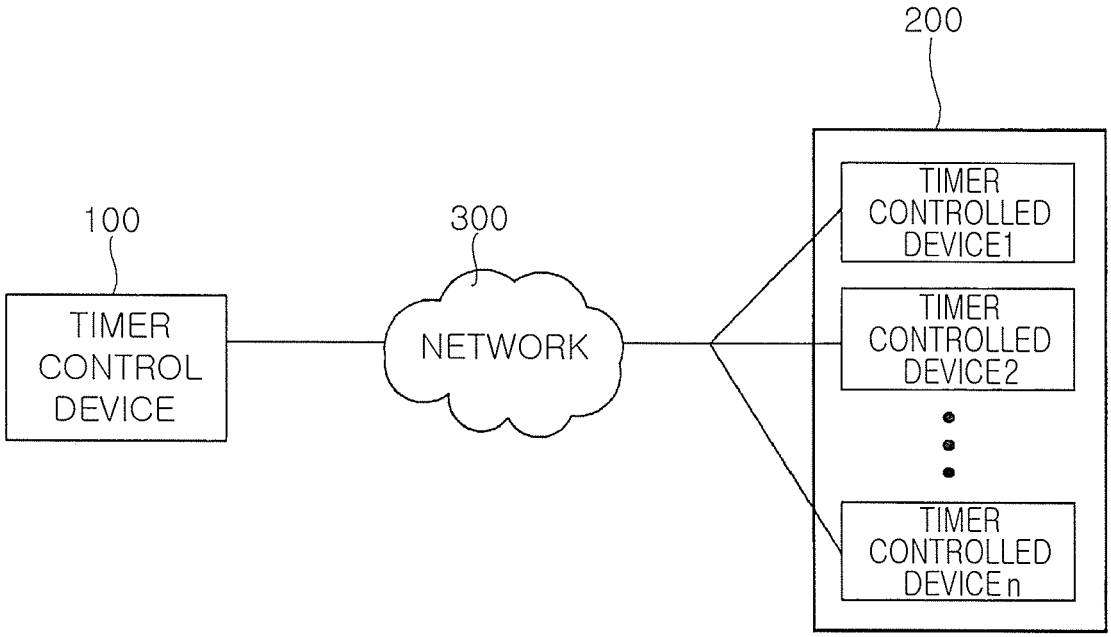
FIG. 1 is a configuration diagram illustrating a system for controlling a timer via a network, according to an exemplary embodiment of the present invention.

The attached drawings for illustrating preferred embodiments of the present invention are referred to in order to gain a sufficient understanding of the present invention, the merits thereof, and the objectives accomplished by the implementation of the present invention. Hereinafter, the present invention will be described in detail by explaining preferred embodiments of the invention with reference to the attached drawings. Like reference numerals in the drawings denote like elements.

FIG. 1 is a configuration diagram illustrating a system for controlling a timer via a network, according to an exemplary embodiment of the present invention.

A timer control device 100 sets an operating time and operating method of a timer of at least one timer-controlled device 200 to be controlled, via a network 300.

The operating time of the timer indicates a timer operating time of the timer of the timer-controlled device 200. The timer control device 100 generates a timer control message by using a time zone based on Greenwich mean time (GMT) of a corresponding area and a standard time of the corresponding area, this is, absolute time information and time information indicating the timer operating time and transmits the generated message to the timer-controlled device 200.

The timer-controlled device 200 having the timer built therein is connected to the network 300, receives the control message for controlling operation of the timer via the network 300, and operates the timer according to the control message.

For example, the timer-controlled device 200 may be applied to various home appliances having a timer built therein, such as electronic ovens, electric rice-cookers, air-conditioners, electric fans, and televisions, sporting goods, and measuring apparatuses used in remote medical treatment.

Figure 2:
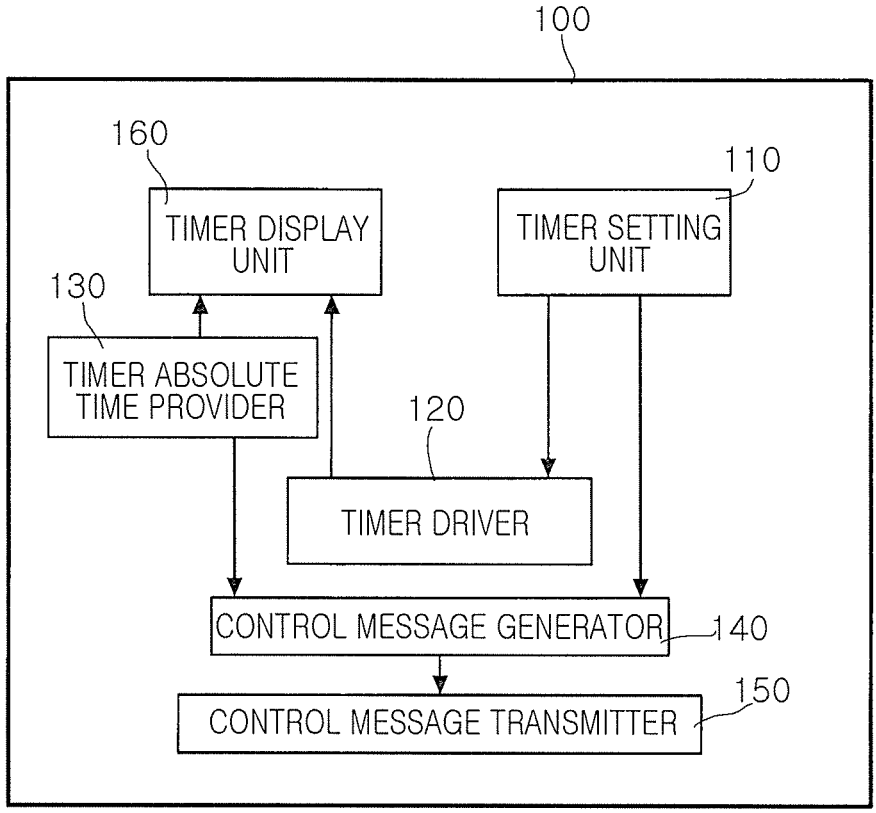
FIG. 2 is a functional block diagram illustrating a timer control device according to an exemplary embodiment of the present invention.

FIG. 2 is a functional block diagram illustrating a detailed configuration of the timer control device 100 in the system according to an exemplary embodiment of the present invention. The timer control device 100 includes a timer setting unit 110, a timer driver 120, a timer absolute time provider 130, a control message generator 140, a control message transmitter 150, and a timer display unit 160.

The timer setting unit 110 sets the timer operating time and operating method of the at least one timer-controlled device 200 via the network 300.

In detail, a time for controlling the timer built in the timer-controlled device 200, this is, the timer operating time of the timer-controlled device 200 is inputted from a user.

The timer driver 120 controls its own timer built in the timer control device 100.

The timer driver 120 sets an operating time of the timer of the timer control device 100 is set to be identical to the timer operating time of the timer setting unit 110 and operates the timer of the timer control device 100. The timer operating time is displayed on the timer display unit 160 to allow the user located in a distant place to check a time of the timer.

The timer absolute time provider 130 provides a time zone of an area in which the timer control device 100 is located, based on the GMT, and a standard time of the area.

In this case, the GMT is a mean solar time of Greenwich meridian with longitude 0° and each local time of all countries of the world is determined based on the GMT.

Also, the standard time is set by using 24 of standard longitudinal meridians (large circles vertically cutting the equator from the north pole to the south pole) departed from a prime meridian passing through Greenwich in England by 15°. Theoretically, the meridians are located in the centers of 24 of standard time zones, respectively. The standard time is identical in each time zone.

Also, the time zone may be imaginarily shown on the earth at intervals of longitude 15° from the north pole to the south pole. In a section of the interval, an identical standard time is used and a time zone is determined based on the standard time.

As described above, the standard time is shown as the GMT+A time in which A is a time zone of a corresponding area, which indicates that a time of the corresponding area is faster than the GMT by the A time.

The standard time is displayed on the timer display unit 160 together with the timer operating time of the timer driver 120, provided by the timer absolute time provider 130.

The control message generator 140 combines the standard times of the timer setting unit 110 and the timer absolute time provider 130 and generates a recognizable message to control the timer built in the timer-controlled device 200.

In this case, the operating time of the timer setting unit 110 is the operating time of the timer built in the timer-controlled device 200 the user wants to control. The standard time of the timer absolute time provider 130 indicates a point in time when the timer operating time is set in the timer setting unit 110.

Figure 3:
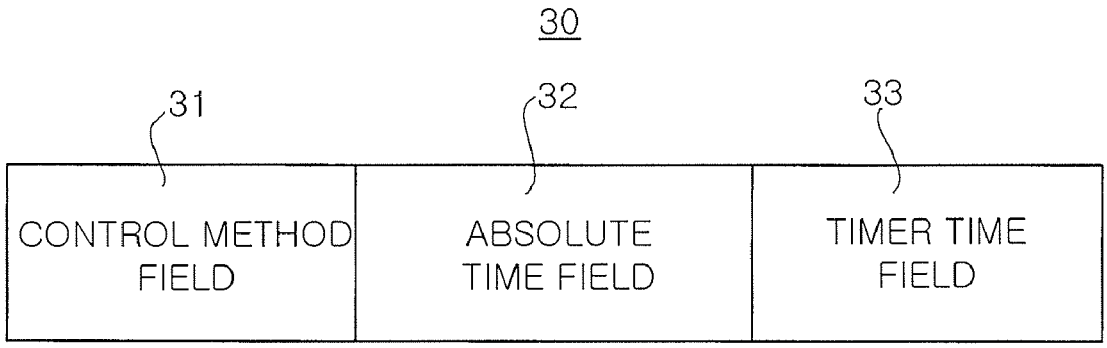
FIG. 3 is a functional block diagram illustrating a configuration of a message according to an exemplary embodiment of the present invention.

Referring to FIG. 3, The message 30 generated by the control message generator 140 includes a control method field 31, an absolute time field 32 indicating the time zone and the standard time provided by the timer absolute time provider 130, and a timer time field 33 indicating an operating time of the timer to be controlled according to characteristics of the timer-controlled device 200.

In detail, for example, when the control method field 31 shows absolute time start-timer start (S-S), the absolute time field 32 shows GMT+09:00, a standard time of a corresponding area is Fri Feb 10 11:12:58 2006, and the timer time field 33 is 00:00:00 (hours: minutes: seconds), the timer is set as 00:00:00 (hours: minutes: seconds) at the standard time and increases as time goes by.

For example, when the control method field 31 indicates absolute time start-timer stop (S-E), the absolute time field 32 is GMT+9:00 Fri Feb 10 11:14:58 2006, and the timer time field 33 is 00:30:00 (hours: minutes: seconds), the timer is set as 30 minutes at the Fri Feb 10 11:14:58 2006 and a time of the timer is reduced as time goes by.

The control message transmitter 150 transmits the control message generated by the control message generator 140 to the timer-controlled device 200.

Figure 4:
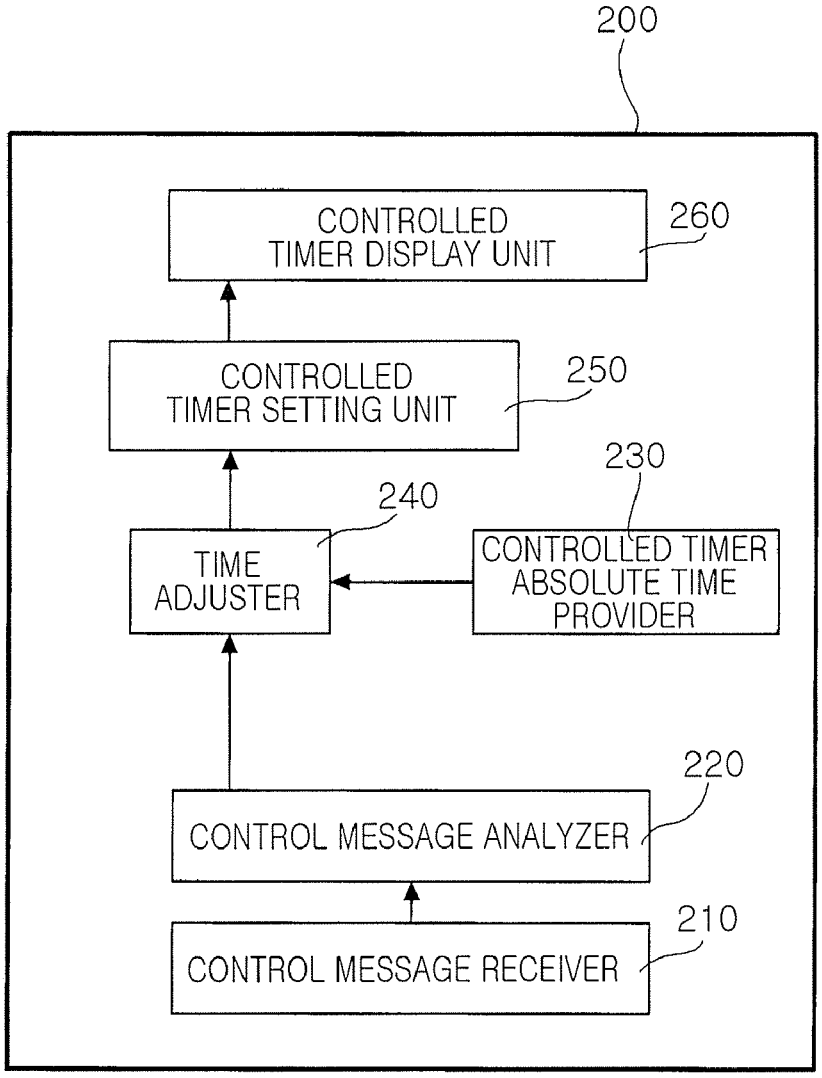
FIG. 4 is a functional block diagram illustrating a timer-controlled device according to an exemplary embodiment of the present invention.

FIG. 4 is a functional block diagram illustrating a configuration of the timer-controlled device 200 in the system according to an exemplary embodiment of the present invention. The timer-controlled device 200 includes a control message receiver 210, a control message analyzer 220, a controlled timer absolute time provider 230, a time adjuster 240, a controlled timer setting unit 250, and a controlled timer display unit 260.

The control message receiver 210 of the timer-controlled device 200 receives a control message transmitted from the timer control device 100 via the network 300.

The message received by the control message receiver 210 includes the control method field 31, the absolute time field 32, and the timer time field like as FIG. 3.

The control message analyzer 220 analyzes the message for each field to drive the timer built in the timer-controlled device 200 and extracts the operating time and operating method to operate the timer built in the timer-controlled device 200.

The controlled timer absolute time provider 230 provides a time zone of the area in which the timer-controlled device 200 is located and the standard time of the corresponding area.

The time adjuster 240 compares the standard time extracted by the control message analyzer 220 with the standard time provided by the controlled timer absolute time provider 230 and adjusts the timer operating time extracted by the control message analyzer 220 by a time difference there between.

Also, the time adjuster 240 compares the time zone extracted from the control message with the time zone of the controlled timer absolute time provider 230 and adjusts a time difference of the standard time of the control message by a time difference therebetween. The time adjuster 240 compares the adjusted standard time with the standard time of the controlled timer absolute time provider 230 and adjusts the timer operating time by a time difference therebetween.

The controlled timer setting unit 250 sets the timer operating time of the timer-controlled device 200 by using time information of the control message analyzer 220 and the time adjuster 240 and displays the time information and absolute time information provided by the controlled timer absolute time provider 230 on the controlled timer display unit 260.

Hereinafter, a method of controlling a timer via a network, performed by the timer control device 100 and timer-controlled device 200 according to an exemplary embodiment of the present invention, will be described with reference to FIGS. 5A, 5B, and 5C.

Figure 5A:
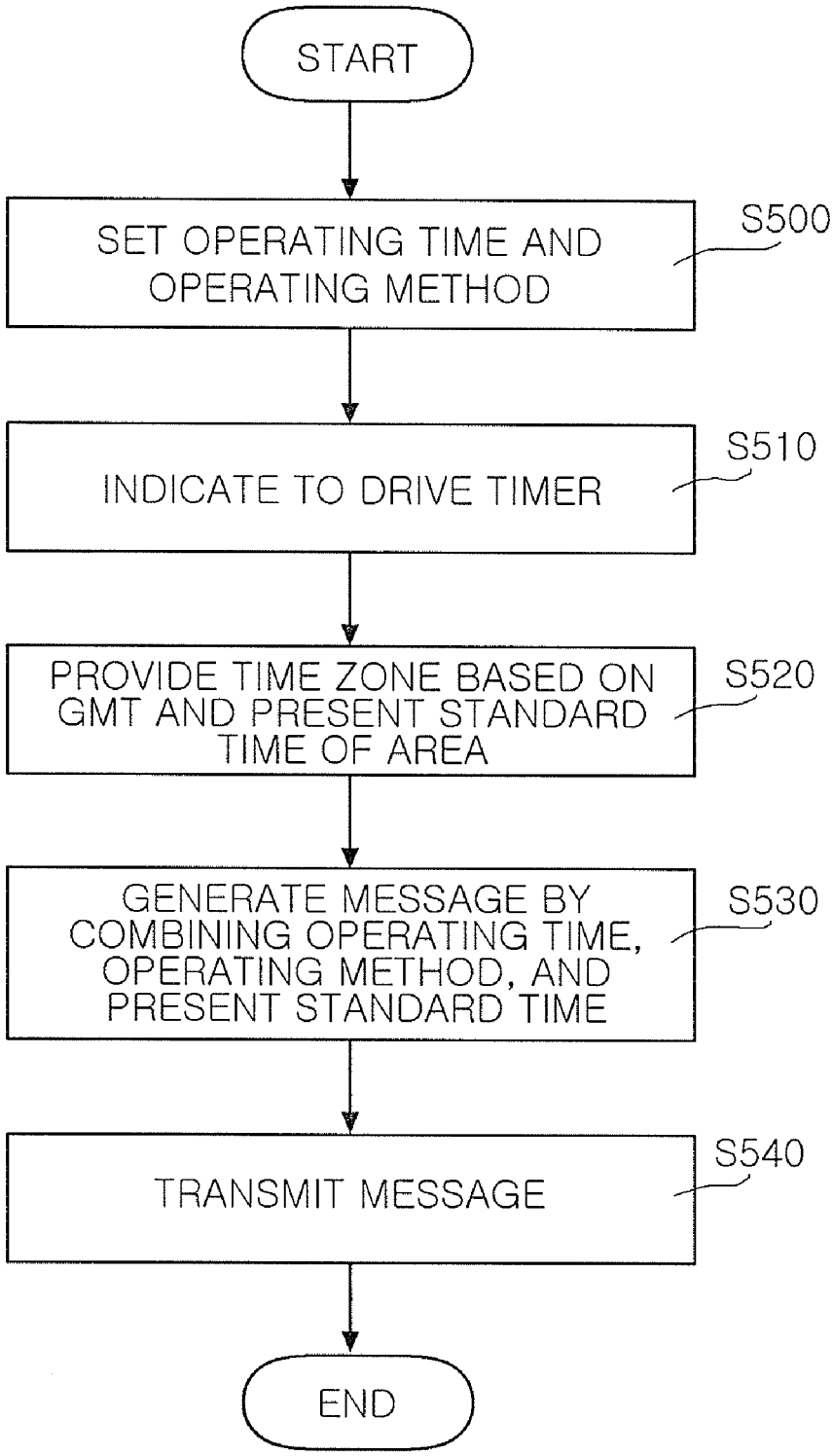
FIGS. 5A, 5B, and 5C are flowcharts illustrating operations of the system for controlling a timer via a network, according to an exemplary embodiment of the present invention.

Referring to FIG. 5A, in the timer control device 100, an operating time and operating method of the timer-controlled device 200 are set (S500). For example, when to control a timer of an electric rice-cooker to be set as 30 minutes to boil rice, an operating time is set as 30 minutes by the timer setting unit 110 and a timer of the timer control device is set as to be driven by 30 minutes (S510). A time zone based on the GMT of an area in which the timer control device 100 is located and a standard time of the area are obtained (S520).

A control message is generated by using the operating time, the operating method, the time zone based on the GMT of the area in which the timer control device 100 is located and the standard time of the corresponding area (S530).

For example, in the control method field of the control message describes a method of operating a timer built in an electric rice-cooker. In the absolute time field 32, "GMT+9 time zone and standard time Fri Feb 15:05:50 2006" is described. In the timer time field 33, 30 minutes is recorded as a time operating time. The control message generated as described above is transmitted via the network 300 (S540).

Figure 5B:
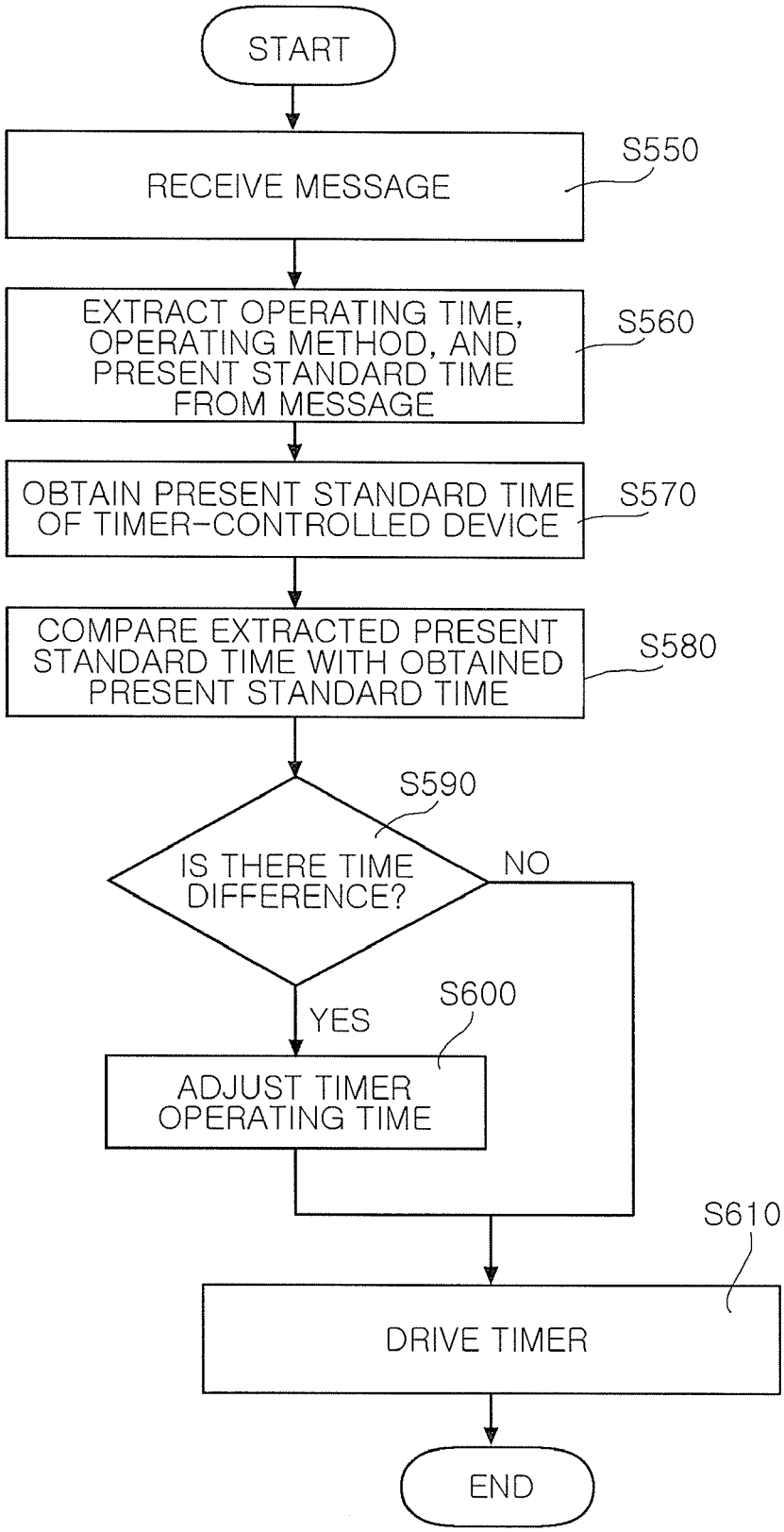

Referring to FIG. 5B, in the timer-controlled device 200, the control message is received via the network 300 (S550). The operating time, the operating method, and the standard time are extracted by analyzing the received control message (S560). A standard time of an area in which the timer-controlled device 200 is located is obtained (S570).

In this case, the standard time extracted from the control message, for example, Fri 7 Feb 08:05:50 2006, is compared with a standard time of an area in which the electric rice-cooker is located, for example, Fri 7 Feb 08:05:59 2006 (S580). When a time difference therebetween occurs (S590), a timer operating time is adjusted by the time difference (S600). The timer built in the electric rice-cooker is driven (S610).

In this case, since there is a time difference of 9 seconds between the standard time of the control message and the standard time of the electric rice-cooker, 9 seconds are subtracted from the timer operating time 30 minutes.

Figure 5C:
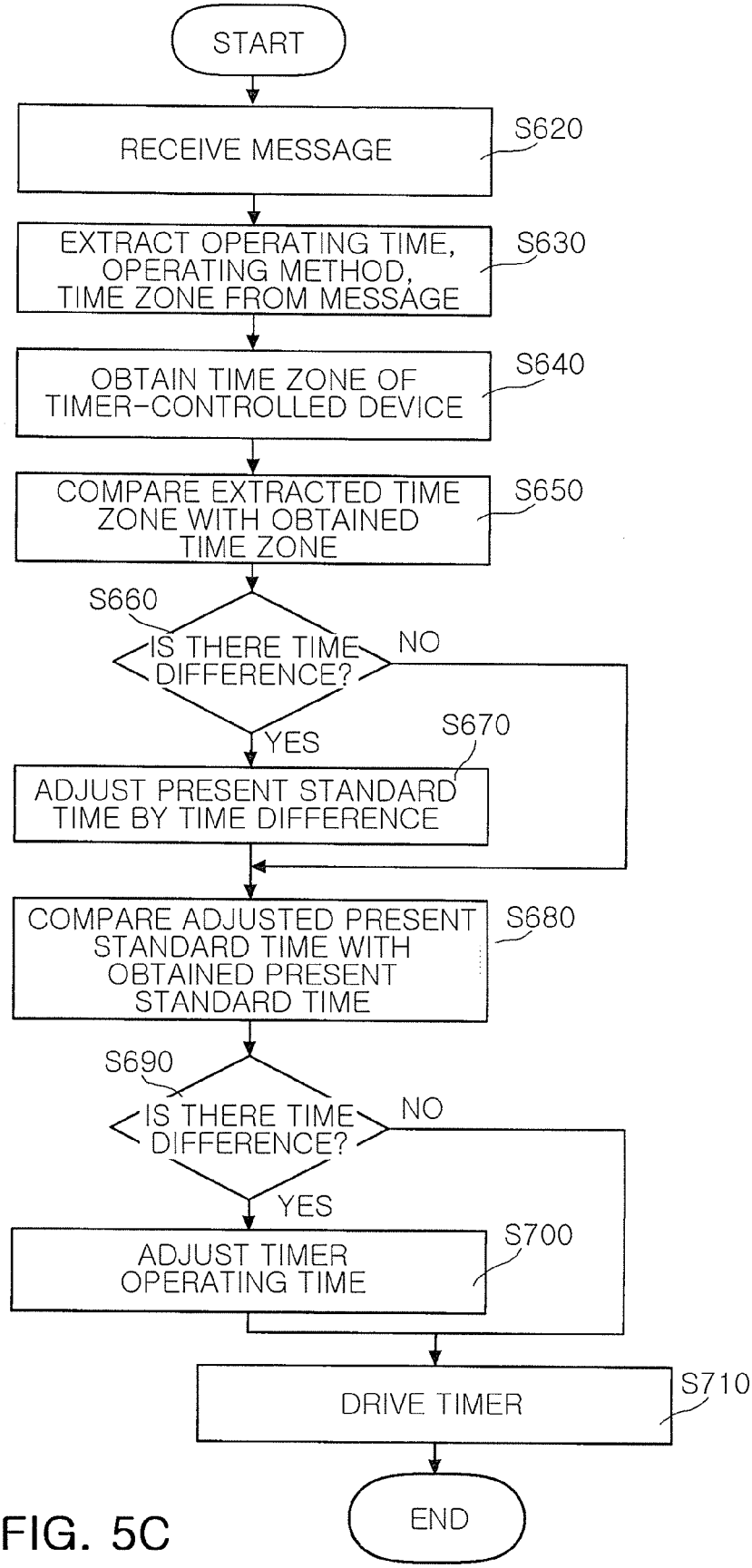

Referring to FIG. 5C, for example, the timer-controlled device 200 receives the control message via the network 300 (S620). An operating time, an operating method, and a time zone are extracted by analyzing the received control message (S630). A time zone of an area in which the timer-controlled device 200 is located is obtained (S640).

The time zone included in the control message, for example, GMT+9 time zone, is compared with the time zone in which the timer-controlled device 200, for example, the electric rice-cooker is located (S650). When there is a time difference therebetween (S660), a standard time of the control message is adjusted by the time difference (S670).

For example, when a user located in Korea (GMT+9 time zone) wants to control a timer of a timer-controlled device located in Chicago in U.S.A (GMT−6 time zone), since there is a time difference of 15 hours between Korea and Chicago in U.S.A because time in Korea goes ahead of time in Chicago in U.S.A, a standard time of a control message is adjusted from 6 pm to 9 am.

The adjusted standard time is compared with a standard time of the timer-controlled device 200 (S680). When there is a time difference (S690), the timer operating time extracted from the control message is adjusted by the time difference (S700). The timer is set as to be driven by the adjusted operating time (S710).

The present invention may be applied to all electronic devices having a timer built therein. For example, in the case of marathon, a plurality of timers of a lot of marathoners may be automatically started simultaneously with start. In the case of telemedicine in real time, a practitioner refers to data sent from a remote measuring apparatus and adjusts and transmits a time required in measurement to the remote measuring apparatus in real time to allow a patient to know the time required in measuring a signal in real time, thereby enabling the telemedicine in real time. In the case of electronic appliances having a timer built therein, such as electric rice-cooker and electronic range, the timer may be easily set in a distance place. As described above, the present invention may be applied in various additional forms having a timer function.

As described above, according to an exemplary embodiment of the present invention, a timer located in a distant area may be easily and accurately controlled via a network without communication barrier or time difference, thereby controlling a plurality of timers via the network at any time according to necessity without manually controlling the plurality of timers one by one.

While the present invention has been shown and described in connection with the exemplary embodiments, it will be apparent to those skilled in the art that modifications and variations can be made without departing from the spirit and scope of the invention as defined by the appended claims.

What is claimed is:

1. A timer control device controlling at least one timer-controlled device having a timer built therein via a network, the timer control device comprising:

a timer setting unit setting an operating time and an operating method of the timer built in the timer-controlled device;

a timer absolute time provider providing a standard time of an area in which the timer control device is located;

a control message generator generating a control message the, control message comprising:

a control method field indicating either an absolute time start-timer start (S-S) condition or an absolute time start-timer stop (S-E) condition, wherein S-S condition controls the timer of the timer-controlled device to increase as time proceeds, and the S-E condition controls that timer of the timer-controlled device to decrease as time proceeds;

an absolute time field indicating the time zone and the standard time provided from the timer absolute time provider; and a timer time field indicating an operating time of the timer of the timer-controlled device in accordance to characteristics of the timer controlled device, wherein the control message generator combines the operating time and operating method of the timer of the timer setting unit with the standard time of the timer absolute time provider; and a control message transmitter transmitting the control message generated by the control message generator to the timer-controlled device.

2. The timer control device of claim 1, wherein the timer absolute time provider provides a time zone based on Greenwich mean time, the time zone corresponding to the area in which the timer control device is located.

3. The timer control device of claim 1, wherein the control message comprises:

the control method field for describing the operating method of the timer;

the absolute time field for displaying the standard time of the area in which the timer control device is located; and the timer time field for displaying the operating time of the timer.

4. The timer control device of claim 3, wherein the absolute time field displays the time zone based on Greenwich mean time, the time zone corresponding to the area in which the timer control device is located.

5. The device of claim 1, further comprising:

a timer driver operating a timer of the timer control device to be identical to the operating time set by the timer setting unit; and a timer display unit displaying the operating time of the timer driver, the time zone of the absolute time provider, and the standard time of the area.

6. A timer-controlled device having a timer, the timer-controlled device comprising:

a control message receiver receiving a control message via a network in which the control message comprises a control method field indicating either an absolute time start-timer start (S-S) condition or an absolute time start-timer stop (S-E) condition, wherein S-S condition controls the timer of the timer-controlled device to increase as time proceeds, and the S-E condition controls that timer of the timer-controlled device to decrease as time proceeds;

an absolute time field indicating a time zone and a standard time provided from a timer absolute time provider; and a timer time field indicating an operating time of the timer of the timer-controlled device in accordance to characteristics of the timer controlled device;

a control message analyzer analyzing the control message received by the control message receiver and extracting an operating time and operating method of the timer of the timer-controlled device and the standard time of an area from which the control message is transmitted;

a controlled timer absolute time provider providing the standard time of an area in which the timer-controlled device is located; and a controlled timer setting unit operating the timer according to the operating time and operating method of the timer.

7. The timer-controlled device of claim 6, further comprising a time adjuster comparing the standard time extracted by the control message analyzer with the standard time provided by the controlled timer absolute time provider and adjusting the operating time of the timer, extracted by the control message analyzer by a time difference therebetween.

8. The timer-controlled device of claim 6, further comprising a controlled timer display unit displaying a time set by the controlled timer setting unit and the standard time provided by the controlled timer absolute time provider.

9. The timer-controlled device of claim 6, wherein the control message analyzer further extracts a time zone of the area from which the message is transmitted.

10. The timer-controlled device of claim 9, wherein the controlled timer absolute time provider further provides a time zone of the area in which the timer-controlled device is located.

11. The timer-controlled device of claim 10, wherein the time adjuster compares the time zone extracted from the control message with the time zone provided by the controlled timer absolute time provider, adjusts the standard time of the control message by a time difference therebetween, compares the adjusted standard time with the standard time of the controlled timer absolute time provider, and adjusts the operating time of the timer by a time difference therebetween.

12. A timer control system comprising:

at least one timer control device comprising:

a timer setting unit setting an operating time and an operating method of a timer built in the at least one timer-controlled device;

a timer absolute time provider providing a standard time of an area in which the timer control device is located;

a control message generator generating a control message, the control message comprising a control method field indicating either an absolute time start-timer start (S-S) condition or an absolute time start-timer stop (S-E) condition, wherein S-S condition controls a timer of a timer-controlled device to increase as time proceeds, and the S-E condition controls that timer of the timer-controlled device to decrease as time proceeds;

an absolute time field indicating a time zone and the standard time provided from the timer absolute time provider; and a timer time field indicating an operating time of the timer of the timer-controlled device in accordance to characteristics of the timer controlled device wherein the control message generator combines the operating time and operating method of the timer of the timer setting unit with the standard time of the timer absolute time provider; and a control message transmitter transmitting the control message generated by the control message generator to timer-controlled device; and at least one timer-controlled device comprising:

a control message receiver receiving a message via a network;

a control message analyzer analyzing the control message received by the control message receiver and extracting an operating time and operating method of the timer of the timed-controlled device and a standard time of an area from which the control message is transmitted;

a controlled timer absolute time provider providing a standard time of an area in which the timer-controlled device is located;

a time adjuster comparing the standard time extracted by the control message analyzer with the standard time provided by the controlled timer absolute time provider and adjusting the operating time of the timer of the timed-controlled device, extracted by the control message analyzer by a time difference therebetween; and a controlled timer setting unit operating the timer of the timed-controlled device according to the operating time of the timer of the timed-controlled device, adjusted by the time adjuster.

* * * * *